United States Patent [19]

Morais et al.

[11] 4,437,042

[45] Mar. 13, 1984

[54] STARTING AND OPERATING CIRCUIT FOR GASEOUS DISCHARGE LAMPS

[75] Inventors: Don Morais, Danville, Ill.; Daniel V. Owen, Hendersonville, N.C.

[73] Assignee: General Electric Company, Schenectady, N.Y.

[21] Appl. No.: 329,533

[22] Filed: Dec. 10, 1981

[51] Int. Cl.[3] ..... H05B 37/00; H05B 39/00; H05B 41/14

[52] U.S. Cl. ..... 315/289; 315/307; 315/DIG. 5

[58] Field of Search ..... 315/127, 276, 289, 306, 315/307, DIG. 5, DIG. 7, 209 R, 219, 225; 331/62; 363/50; 328/8; 361/111

[56] References Cited

U.S. PATENT DOCUMENTS

| | | | |
|---|---|---|---|
| 3,740,609 | 6/1973 | Moerkens | 315/200 |
| 4,087,723 | 5/1978 | Chermin et al. | 315/207 |
| 4,177,403 | 12/1979 | Remery | 315/101 |
| 4,331,905 | 5/1982 | Owen | 315/289 |
| 4,378,514 | 3/1983 | Collins | 315/225 |

*Primary Examiner*—David K. Moore
*Assistant Examiner*—Robert E. Wise
*Attorney, Agent, or Firm*—Ernest W. Legree; Philip L. Schlamp; Fred Jacob

[57] ABSTRACT

Starting and operating circuit for gaseous discharge lamps having device for quickly restarting extinguished lamps while still hot includes means for reducing power supply voltage overshoot upon turn-on of the system. Circuit comprises a source of alternating current, an inductive regulator ballast having its input connected to the alternating current source, and a gaseous discharge lamp connected to the output of the ballast, a sine wave oscillator circuit having its input connected to the current supply and having its output connected to a transformer connected in series between the ballast and the lamp for stepping up and applying voltage to the lamp, a rectifier connected between the alternating current source and the oscillator circuit, the overshoot reducing means comprising a resistor connected between the rectifier and the oscillator circuit and a controlled switch for selectively connecting and disconnecting the resistor in the circuit.

15 Claims, 4 Drawing Figures

STARTING AND OPERATING CIRCUIT FOR GASEOUS DISCHARGE LAMPS

The present invention relates to discharge lamp starting and operating circuits, and particularly concerns such circuits for quickly restarting extinguished high intensity gaseous discharge lamps while still hot.

Known types of circuits for starting and ballasting high intensity discharge lamps have the disadvantage that when power is briefly removed from the system, the lamp rapidly deionizes and ceases to conduct current upon reapplication of power. This temporary outage may last from 1 minute up to as much as 15 minutes depending on lamp type and cause interruption of work operations or other activities until the lamp is restarted. In the past, various devices for quickly restarting the lamp have been suggested, but known devices and circuits of this type have generally been expensive, complicated in structure or unreliable in operation.

An improved circuit of the above type is disclosed and claimed in copending application of Collins, Ser. No. 201,014 filed Oct. 27, 1980, now U.S. Pat. No. 4,378,514 Starting and Operating Circuit for Gaseous Discharge Lamp, and the present invention concerns an improvement in the circuit disclosed in the Collins' application.

It is an object of the invention to provide an improved circuit of the above type for starting and operating gaseous discharge lamps.

It is a particular object of the invention to provide a circuit of the above type having a protective device to prevent excessive power supply voltage on the system, especially upon turn-on of the circuit.

Another object of the invention is to provide a circuit of the above type having means to control the operation of the aforementioned protective device.

Other objects and advantages will become apparent from the following description and the appended claims.

With the above objects in view, the present invention in one of its aspects relates to a starting and operating circuit for gaseous discharge lamps comprising, in combination, a source of current, inductive ballast means connected at its input side to the current source, discharge lamp means connected to the output side of the ballast means, transformer means connected in series between the discharge lamp means and the ballast means, sine wave oscillator means connected at its input side to the current source through the ballast means and at its output side to the transformer means whereby the transformer means steps up and applies to the discharge lamp means sine wave voltage produced by the oscillator means for starting and restarting the discharge lamp means, the circuit being subject to overshoot of voltage from the current source to the oscillator means, and means connected across the current source for limiting the voltage overshoot.

In a preferred embodiment, the voltage overshoot limiting means comprises a bleeder resistor connected between rectifier means connected to the ballast means and supplying the oscillator means, and a controlled switch for selectively connecting and disconnecting the resistor in the circuit.

The invention will be better understood from the following description taken in conjunction with the accompanying drawings, in which.

Figure 1:
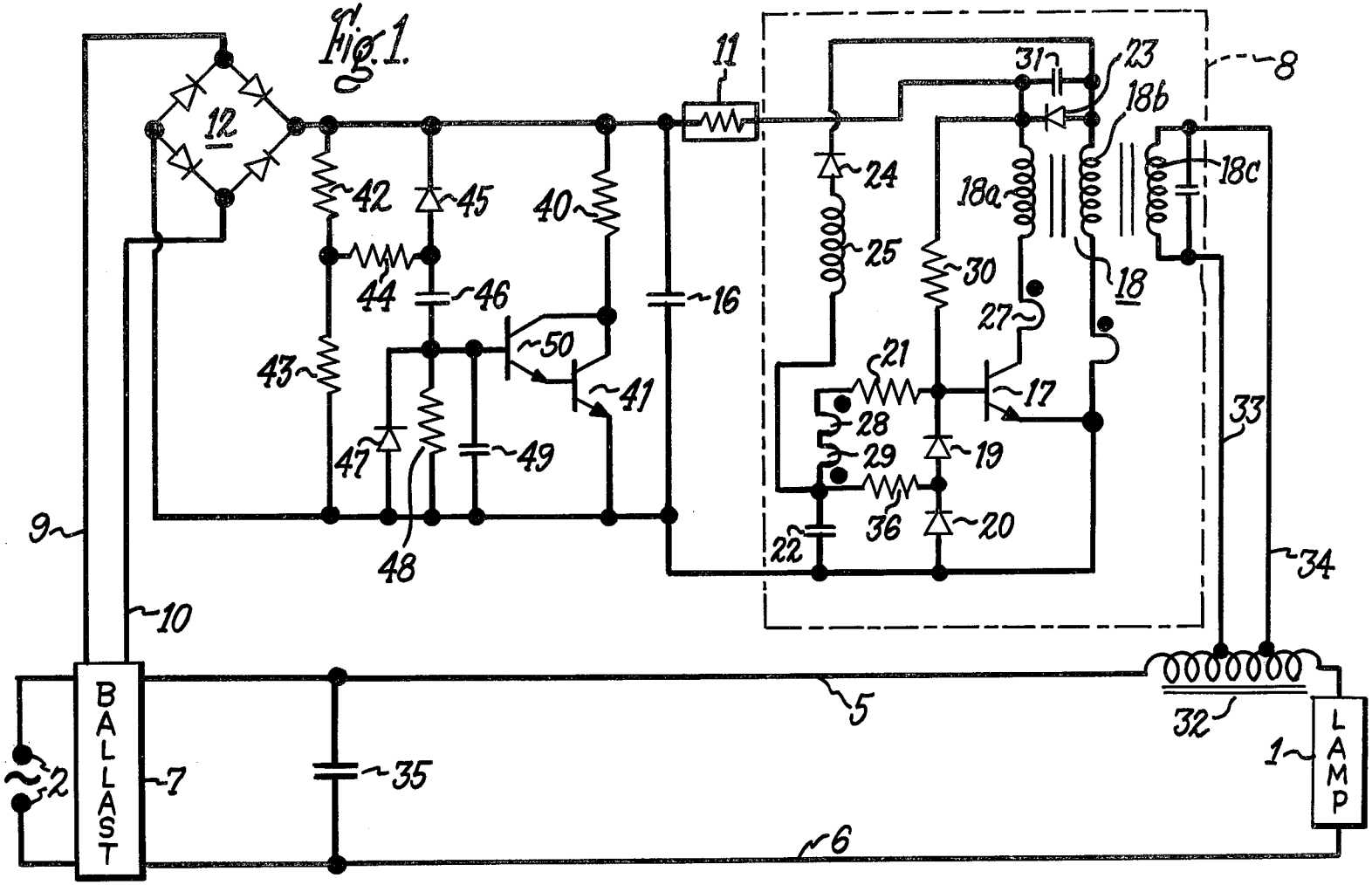
FIG. 1 is a circuit diagram of a discharge lamp starting and operating circuit having a protective circuit for limiting power supply voltage overshoot in accordance with an embodiment of the invention.

Referring now to the drawings, and particularly to FIG. 1, there is shown a starting and operating circuit for a high intensity gaseous discharge lamp 1, typically a high pressure sodium vapor lamp or other discharge lamp, which requires a relatively high voltage pulse in order to be ignited and which thereafter operates on a lower voltage. Lamp 1 is connected by conductors 5 and 6 to the output of ballast 7 which in turn is connected to terminals 2 of an alternating current source, typically 120 volts. Ballast 7, which may be any of known types of inductive ballast devices, provides current limiting impedance as is conventional in discharge lamp circuits.

A sine wave oscillator circuit is employed to provide a high voltage, high frequency sine wave, e.g., in the range of 1600 to 200,000 Hz, for not only starting lamp 1 when cold but also for quickly restarting the extinguished lamp while still hot, and there is further provided variable impedance means for reducing the voltage applied to the oscillator circuit should the lamp be inoperative or be absent. For these purposes there is provided in the circuit shown in FIG. 1 sine wave oscillator circuit 8 connected by conductors 9 and 10 to ballast 7 as shown, including variable impedance means in the form of a positive temperature coefficient resistor (PTCR) 11 connected in series between bridge rectifier means 12 driven by ballast 7 and oscillator circuit 8. As well understood in the art, the PTCR has low resistance when cool and as it gradually heats up due to passage of current therethough, its resistance correspondingly increases. The particular oscillator circuit illustrated is, in its main construction, of known type, as shown, for example, in U.S. Pat. No. 4,202,031—Hesler et al (see particularly FIGS. 1 and 7 of the patent and the description relating thereto), and as modified by the inventions disclosed in the aforementioned Collins application, in copending application of Owen, Ser. No. 201,013 filed Oct. 27, 1980, now U.S. Pat. No. 4,331,905 Starting and Operating Circuit for Gaseous Discharge Lamps, and in copending application of Smith et al, Ser. No. 206,863 filed Nov. 14, 1980, now U.S. Pat. No. 4,333,139, Static Inverter, all of said patent and copending applications being assigned to the same assignee as the present invention, and the disclosures thereof are accordingly incorporated herein by reference.

As shown in the illustrated circuit, there is connected to one of the outputs of ballast 7 full wave rectifier 12 serving as a direct current source, filter capacitor 16, power transistor 17, transformer 18, diodes 19 and 20, resistors 21 and 30 and capacitor 22, the circuit components being connected as shown to provide for turning on and controlling the operation of the transistor, and the combination functioning as a sine wave oscillator. Transformer 18 comprises primary winding **18*a*, demagnetizing winding 18*b* and secondary winding 18*c*, the latter winding being connected by conductors 33 and 34 to a coupling transformer 32, such as the autotransformer shown, connected to conductor 5 in series with lamp 1. Transformer 18 also comprises three feedback windings 27, 28, 29 which serve to control the operation of transistor 17. The base of transistor 17 is connected to a starting and control network comprising resistor 30, diodes 19 and 20, feedback windings 28,29, resistor 21 and capacitor 22. Diode 23 connected to windings 18***a*, 18*b* serves to protect transistor 17 from high voltage surges.

A turn-off mechanism comprising series connected diode 24 and inductor 25 is provided in the oscillator circuit for stopping operation of the oscillator during normal lamp operation without interfering with normal restarting functions of the oscillator circuit.

Further details of the elements, arrangement and operation of the oscillator circuit and modifications thereof are set forth in the aforementioned Hesler et al. patent and copending Owen and Smith et al. applications.

It has been found that in circuits of the above described type, when the oscillator circuit is turned on, a relatively high voltage from the power supply (herein called voltage overshoot) is initially produced on the oscillator circuit, apparently by the turn-on surge in ballast 7, such overshoot at times being about twice the peak amplitude of the steady state voltage. As a result, it was necessary to provide extra insulation and employ circuit components which would withstand such higher initial voltage, thus unduly increasing the cost of the system.

In accordance with the present invention, a protective circuit is provided in association with the oscillator circuit to limit the described voltage overshoot and thereby avoid the aforementioned disadvantages. One embodiment of such a protective circuit is shown in the simplified diagram of FIG. 2, and as there shown, the protective device comprises resistor R in series with switch S connected across the power supply terminals 2*a*,2*a* between rectifier 12 and load 8 which represents the oscillator circuit.

Shown in the FIG. 1 circuit is a particular form of such a protective device comprising resistor 40 in series with transistor 41 connected in parallel with filter capacitor 16. A control circuit for providing a timed turn-on for transistor 41 and for turning off the latter during normal operation of the oscillator circuit comprises a voltage divider including resistor 42 and 43 connected in series across the DC supply. Diode 45 and capacitor 46 are connected in series, with the cathode of diode 45 connected to the positive side of the DC supply and the anode connected to capacitor 46. Resistor 44 is connected at one side to the junction of resistors 42 and 43 at the other side to the junction of diode 45 and capacitor 46. The other side of capacitor 46 is connected to the base of transistor 50, the collector of the latter being connected to the collector of transistor 41 and its emitter connected to the base of transistor 41. Diode 47, resistor 48, and capacitor 49 are all connected in parallel, and the parallel combination connected between the base of transistor 50 and the negative side of the DC supply, with the anode of diode 47 being connected to the negative side of the DC supply. In the described circuit, resistors 48 and 44 together with capacitor 46 function as an RC differentiator; by viture of capacitor 49 being considerably lower in value than capacitor 46, typically less than one-tenth as much, resistor 44 and capacitor 49 function as an RC integrator, the time constant of the latter being substantially less than that of the RC differentiator; however resistor 44 and capacitor 46 make up an RC time constant which determines the time delay of the circuit.

In the operation of the described protective circuit, when power is applied, current flows through resistor 42 and divides into a current through resistor 43 and a current through resistor 44, capacitor 46 and the base circuit of transistor 50. As soon as capacitor 49 (which is considerably lower in value than capacitor 46 as earlier stated charges to the base-emitter drop of transistor 50, a current flows into the base of transistor 50, turning the latter transistor on and simultaneously turning on transistor 41 to which transistor 50 is coupled in a conventional Darlington connection. Bleeder resistor 40 thus is connected across capacitor 16 and very quickly bleeds any overshoot voltage on capacitor 16 back to normal power supply voltage.

As current continues to flow to transistor 41, capacitor 46 charges at a rate depending on its value and the effective value of the combination of resistors 42, 43 and 44. When capacitor 46 charges to a voltage equal to the voltage at the junction of the voltage divider, current through resistor 44 and the base circuit of transistor 50 ceases. Resistor 48 then discharges capacitor 49, so that transistor 50 is no longer forward biased, causing transistor 50 to stop conducting and thereby turning transistor 41 off also, thus effectively disconnecting resistor 40. The circuit remains in this condition as long as power is applied. Typically, the oscillator circuit starts operation just prior to the described turn-off of transistors 41 and 50, but by this time the risk of supply voltage overshoot has been prevented.

When power to the circuit is removed or interrupted, resistors 42 and 43 along with oscillator circuit 8 draw current from capacitor 16. When the voltage on capacitor 16 drops below the voltage of capacitor 46, current flows through diode 47, capacitor 46, diode 45, and bleeder resistors 42 and 43 and the oscillator circuit, removing the charge on capacitor 46 quickly so that the circuit is ready to operate to above described as shown as power is reapplied.

By virtue of the described arrangement, transistor switches 41 and 50, which may take the form of a Darlington transistor or other types of switch such as a field effect transistor (FET), serve to automatically disconnect resistor 40 from the circuit after the danger of overshoot has passed, and to automatically reconnect resistor 40 when the power supply voltage increases substantially.

Figure 2:
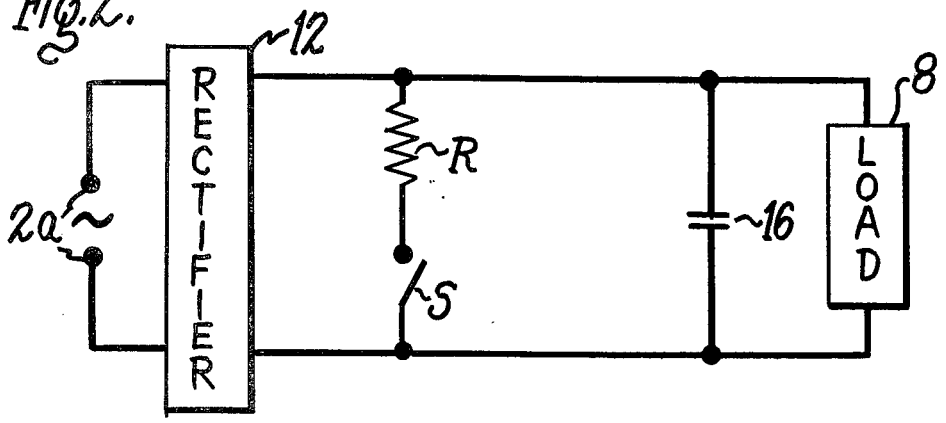
FIG. 2 is a simplified circuit diagram illustrating the protective device shown in the FIG. 1 circuit.
Figure 3:
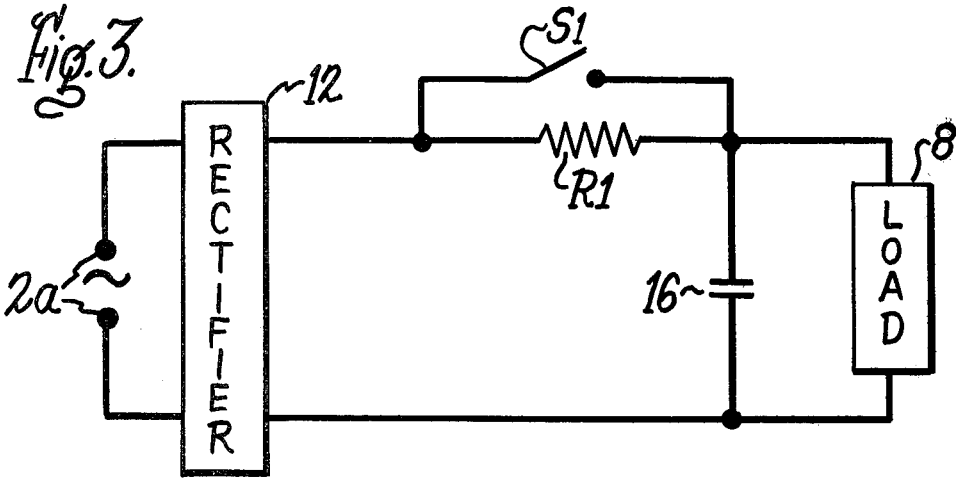
FIGS. 3 and 4 are simplified circuit diagrams illustrating two other types of protective devices in accordance with the invention.

While desirable results have been produced by the circuits illustrated in FIGS. 1 and 2, modifications of such circuits may be employed while still obtaining satisfactory results in accordance with the invention. For example, as shown in FIG. 3, bleeder resistor R1 may be connected in series between the power supply and the oscillator circuit, with a suitable switch S1 connected in parallel with resistor R1. A suitable control circuit (not shown) may be connected to switch S1 for controlling the operation of the switch, it being understood that in this case, S1 is kept closed during normal operation of the oscillator circuit so that the current by-passes bleeder resistor R1, and S1 is opened at the initial turn-on of the circuit so that R1 may function to absorb the voltage overshoot in accordance with the invention.

In a modification of the FIG. 3 circuit (not shown), R1 may comprise a negative temperature coefficient resistor (NTCR) and the switch S1 may be dispensed with. In such an embodiment, the NTCR, having initially a high resistance, will limit the voltage overshoot at turn-on of the circuit and gradually increase its conduction of current thereafter.

Figure 4:
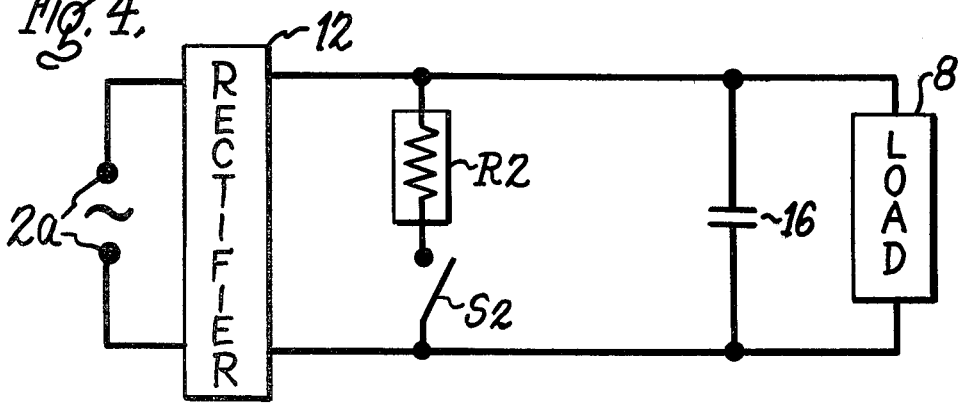

FIG. 4 shows another modification which may be employed, comprising a positive temperature coefficient resistor (PTCR) R2 in series with switch S2 connected across oscillator circuit 8 as shown, switch S2 being connected to a suitable control circuit (not shown). In this embodiment, R2, having initially a low resistance, absorbs the voltage overshoot upon turn-on of the circuit, switch S2 being closed at that time. After the overshoot risk has passed, S2 is opened to prevent dissipation of power through R2 during normal operation of the oscillator circuit, i.e., when R2 has increased resistance. In those cases where R2 is of sufficiently high resistance so as to reduce power dissipation, switch S2 and its control circuit may be dispensed with.

By way of example, in a particular circuit such as shown in FIG. 1 which has provided satisfactory results, the following components of the switch control circuit had the values shown, it being understood that the invention is not intended to be limited by the specific values listed:

| | |
|---|---|
| Diodes 45, 47 | 1 amp. 400 volts |
| Transistors 41, 50 | 1 amp. Vceo = 400 V |
| Resistor 42 | 33 K ohms, 2 watts |
| Resistor 43 | 8.2 K ohms, 1 watt |
| Resistors 44, 48 | 10 K ohms, ½ watt |
| Capacitor 46 | 22 mfd, 50 VDC |
| Capacitor 49 | .47 mfd, 200 VDC |

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What we claim as new and desire to secure by Letters Patent of the United States is:

1. A starting and operating circuit for gaseous discharge lamp comprising, in combination, a source of alternating current, inductive ballast means connected at its input side to said current source, discharge lamp means connected to the output side of said ballast means, transformer means connected in series with said discharge lamp means across said ballast means, sine wave oscillator means connected at its input side through rectifying means to said current source and at its output side of said transformer means whereby said transformer means steps up and applies to said discharge lamp means sine wave voltage produced by said oscillator means for starting and restarting said discharge lamp means, said circuit being subject to overshoot of voltage from said current source to said oscillator means, and means connected to said rectifying means and said oscillator means for limiting said voltage overshoot.

2. A circuit as defined in claim 1, said voltage overshoot limiting means comprising resistance means, and switch means for selectively connecting and disconnecting said resistance means in said circuit.

3. A circuit as defined in claim 2, wherein said resistance means is connected across the output of said rectifying means.

4. A circuit as defined in claim 3, said switch means being connected in series with said resistance means.

5. A circuit as defined in claim 4, and control means for controlling the operation of said switch means connected between said rectifying means and said switch means.

6. A circuit as defined in claim 5, said control means comprising an RC differentiator and an RC integrator connected to said switch means across said rectifier means, the time constant of said RC integrator being substantially less than that of said RC differentiator.

7. A circuit as defined in claim 6, said control means including a pair of resistors forming a voltage divider connected across said rectifier means, said RC differentiator and RC integrator being connected to the junction of said voltage divider.

8. A circuit as defined in claim 7, said control means including unidirectional current means connected to said RC differentiator and RC integrator for quickly discharging said differentiator and integrator.

9. A circuit as defined in claim 6, said switch means comprising transistor means.

10. A circuit as defined in claim 1, said voltage overshoot limiting means comprising variable resistor means.

11. A circuit as defined in claim 10, said variable resistor means being connected across the output of said rectifying means.

12. A circuit as defined in claim 11, and switch means connected in series with said variable resistor means.

13. A circuit as defined in claim 11, said variable resistor means comprising a positive temperature coefficient resistor.

14. A circuit as defined in claim 1, said voltage overshoot limiting means comprising resistor means connected in series between said rectifying means and said oscillator means.

15. A circuit as defined in claim 14, and switch means connected across said resistor means.

* * * * *